US009320340B2

(12) United States Patent
Christenson

(10) Patent No.: US 9,320,340 B2
(45) Date of Patent: Apr. 26, 2016

(54) HAIR APPLIANCE HOLDER

(71) Applicant: Robert Christenson, Anacortes, WA (US)

(72) Inventor: Robert Christenson, Anacortes, WA (US)

( * ) Notice: Subject to any disclaimer, the term of this patent is extended or adjusted under 35 U.S.C. 154(b) by 0 days.

(21) Appl. No.: 14/524,915

(22) Filed: Oct. 27, 2014

(65) Prior Publication Data

US 2015/0041417 A1 Feb. 12, 2015

Related U.S. Application Data

(62) Division of application No. 13/495,891, filed on Jun. 13, 2012, now Pat. No. 8,869,996.

(60) Provisional application No. 61/496,449, filed on Jun. 13, 2011.

(51) Int. Cl.
*A47F 1/04* (2006.01)
*A47F 7/00* (2006.01)
(Continued)

(52) U.S. Cl.
CPC ..... *A45D 44/06* (2013.01); *A45D 2/001* (2013.01); *A45D 20/12* (2013.01); *A45D 44/04* (2013.01); *A47F 5/08* (2013.01); *A47F 7/0028* (2013.01); *A45D 2001/002* (2013.01); *A47F 2005/165* (2013.01)

(58) Field of Classification Search
CPC ..... A45D 44/06; A45D 44/04; A45D 44/02; A45D 44/18; A45D 1/00; A45D 1/04; A45D 4/00; A45D 4/18; A45D 20/00; A45D 20/12; A45D 20/14; A45D 2020/126; A45D 2020/128; A45D 2020/12; A45D 2/001; A45D 2001/002; B23K 3/027; B25H 3/00; B25H 3/04; D06F 57/12; D06F 79/00; D06F 79/02; A47K 1/09; A47B 67/00; A47B 81/005; A47B 87/007; A47B 81/00; A47F 7/00; A47F 7/0028; A47F 7/0035; A47F 7/005; A47F 5/00; A47F 5/08; A47F 5/0807; A47F 5/16; A47F 2005/165; A47F 7/0021; A47G 29/08; A47G 25/06; A47G 29/00; A47G 29/087; F16M 13/00; F16M 13/02
USPC ..... 211/26, 26.2, 70.6, 74, 119.004, 211/119.009, 87.01, 60.1, 13.1; 248/117.2, 248/176.2, 117.3, 314, 316.1, 316.7, 248/231.81, 231.71, 230.6, 230.7; 206/372, 206/373, 349, 320, 581; 34/97, 96; D6/533, D6/567
See application file for complete search history.

(56) References Cited

U.S. PATENT DOCUMENTS 2,707,052 A * 4/1955 Brown ..... 211/65
D199,321 S * 10/1964 Peterson ..... D7/641
(Continued)

OTHER PUBLICATIONS

Salon Bazaar http://www.solonbazaar.com/proaccessories.asp, May 24, 2011.
(Continued)

*Primary Examiner* — Jennifer E Novosad
(74) *Attorney, Agent, or Firm* — Dwayne Rogge; Schacht Law Office, Inc.

(57) ABSTRACT

This disclosure relates to the field of holders for the storage of hair care appliances and similar articles wherein the hair-care appliances are stored (held) for immediate use. A thermal barrier clip for use with flat irons is also disclosed for use with the holder so as to improve safety and increase the lifespan of the flat iron. A hair dryer hook is also disclosed which allows for storage of a hair dryer with a diffuser attached.

10 Claims, 10 Drawing Sheets

(51) Int. Cl.

| | |
|---|---|
| ***A47G 29/087*** | (2006.01) |
| ***A45D 44/04*** | (2006.01) |
| ***A47F 5/08*** | (2006.01) |
| ***A45D 44/06*** | (2006.01) |
| ***A45D 2/00*** | (2006.01) |
| ***A45D 20/12*** | (2006.01) |
| *A47F 5/16* | (2006.01) |
| *A45D 1/00* | (2006.01) |

(56) References Cited

U.S. PATENT DOCUMENTS

| | | | | | |
|---|---|---|---|---|---|
| 4,159,773 | A | * | 7/1979 | Losenno | 211/70.6 |
| 4,446,972 | A | * | 5/1984 | Sussman | 211/26 |
| 5,031,778 | A | * | 7/1991 | Edgecombe | 211/26 |
| 5,054,615 | A | * | 10/1991 | Stillwagon et al. | 206/373 |
| 5,124,532 | A | * | 6/1992 | Hafey et al. | 219/200 |
| 5,232,103 | A | * | 8/1993 | Koenig et al. | 211/69.5 |
| D342,585 | S | * | 12/1993 | Fischbach et al. | D28/38 |
| 5,615,782 | A | * | 4/1997 | Choe | 211/70.6 |
| 5,727,701 | A | * | 3/1998 | Rhoades | 211/70.6 |
| 5,743,415 | A | * | 4/1998 | Smart | 211/70.6 |
| 5,794,799 | A | * | 8/1998 | Collins et al. | 211/70.6 |
| 5,917,694 | A | | 6/1999 | Denny | |
| 6,109,446 | A | * | 8/2000 | Foote | 206/759 |
| D437,711 | S | * | 2/2001 | Berg | D28/73 |
| 6,209,732 | B1 | * | 4/2001 | Dennis et al. | 211/70.6 |
| D469,926 | S | * | 2/2003 | Petruccelli | D28/73 |
| D469,927 | S | * | 2/2003 | Petruccelli | D28/73 |
| 6,595,376 | B1 | * | 7/2003 | Lin | 211/70.6 |
| D487,170 | S | * | 2/2004 | Petruccelli | D28/73 |
| D489,843 | S | * | 5/2004 | Malone | D28/35 |
| D495,215 | S | * | 8/2004 | Massey, Jr. | D7/637 |
| 6,769,554 | B1 | * | 8/2004 | Udofiah | 211/70.6 |
| D552,796 | S | * | 10/2007 | Petruccelli | D28/73 |
| D584,857 | S | * | 1/2009 | Kirschenmann | D28/73 |
| D603,095 | S | * | 10/2009 | Petruccelli | D28/38 |
| D603,562 | S | * | 11/2009 | Mills | D28/73 |
| D607,607 | S | * | 1/2010 | Russell | D28/73 |
| D608,054 | S | * | 1/2010 | Radfar | D28/73 |
| 7,959,240 | B2 | * | 6/2011 | Smith | 312/242 |
| D670,865 | S | * | 11/2012 | Cooper et al. | D28/73 |
| 8,328,013 | B2 | * | 12/2012 | Stevens | 206/373 |
| 8,439,585 | B2 | * | 5/2013 | Silva Rubio et al. | 401/131 |
| 8,869,996 | B1 | * | 10/2014 | Christenson | 211/60.1 |

OTHER PUBLICATIONS

Hair Dryers US:http://www.hair-dryers.us/product_images/g/113/suction-cup-hair-dryer-holder_15201_z , May 24, 2011.

* cited by examiner

HAIR APPLIANCE HOLDER

RELATED APPLICATIONS

This Application is a Divisional application of U.S. patent application Ser. No. 13/495,891 filed on Jun. 13, 2012 incorporated herein by reference. Application Ser. No. 13/495,891 claims priority benefit of U.S. Ser. No. 61/496,449, filed Jun. 13, 2011 also incorporated herein by reference.

BACKGROUND OF THE DISCLOSURE

Field of the Disclosure

This disclosure relates to the field of holders for the storage of hair care appliances and similar articles wherein the hair-care appliances are stored (held) for immediate use.

SUMMARY OF THE DISCLOSURE

Disclosed herein is an appliance holder for hair care appliances with several novel components. The holder comprising: a base which in turn comprises a support surface, an upright portion extending from the support surface, the upright portion defining a support panel; a plurality of appliance holding tubes removably attached to the support surface; and a wall attachment system whereupon the base may be selectively attached to a vertical surface, or may alternatively rest upon a horizontal surface and wherein the appliance holding tubes are operable in either configuration.

The hair appliance holder as disclosed above may further comprise a clip removably attached to the support surface and offset from an adjacent hair appliance holding tube to provide a thermal barrier between the adjacent hair appliance tube and the clip.

The hair appliance holder may also be formed wherein the clip portion further comprises a plurality of wings extending from the clip portion and formed to maintain a heating element portion of a flat iron in thermal isolation from a heating element portion of the flat iron.

The hair appliance holder may further comprise: a hair dryer holding hook removably attached to the support surface. The hair dryer holding hook may further comprising a first arm and a second arm, with a gap provided between distal ends of the first and second arms to allow lateral passage of an exhaust port of the hair dryer. Lateral herein being a direction orthogonal to the major axis of the exhaust portion of the hair dryer.

The hair appliance holder may be arranged wherein the distal end of the first arm of the hair dryer hook is horizontally forward of the distal end of the second arm such that a net distance between the distal end of the second arm and the distal end of the first arm is greater than a vertical offset between the distal end of the second arm and the distal end of the first arm.

The hair care appliance holder may further comprise at least one malleable pad on the first arm and/or the second arm to reduce scratching and other damage, as well at to maintain the hair care appliance within the hook.

A hair dryer holding hook itself is also disclosed as novel in an of itself. The hook in one form comprising: a fastening system for removable attachment of the hair dryer holding hood to a support surface. The independent hook may also comprise a first arm and a second arm with a gap provided between distal ends of the first and second arms to allow lateral passage of an exhaust port of the hair dryer there between.

The hair dryer hook in one embodiment is arranged wherein the distal end of the first arm is horizontally forward of the distal end of the second arm such that a net distance between the distal end of the second arm and the distal end of the first arm is greater than a vertical offset between the distal end of the second arm and the distal end of the first arm.

The hair dryer hook may further comprise at least one malleable pad on the first arm and/or the second arm as previously discussed.

DESCRIPTION OF THE PREFERRED EMBODIMENTS

While hair appliance holders have been used for some time in barbershops, hair salons, beauty schools, and the home, a hair appliance holder which is adaptable for the particular desired configuration of the user is still desired.

In one form, the appliance holder is especially useful as being adaptable from a tabletop arrangement, to a wall mounted arrangement. In either configuration, the holder does not significantly hinder the use of any workspace.

Figure 1:
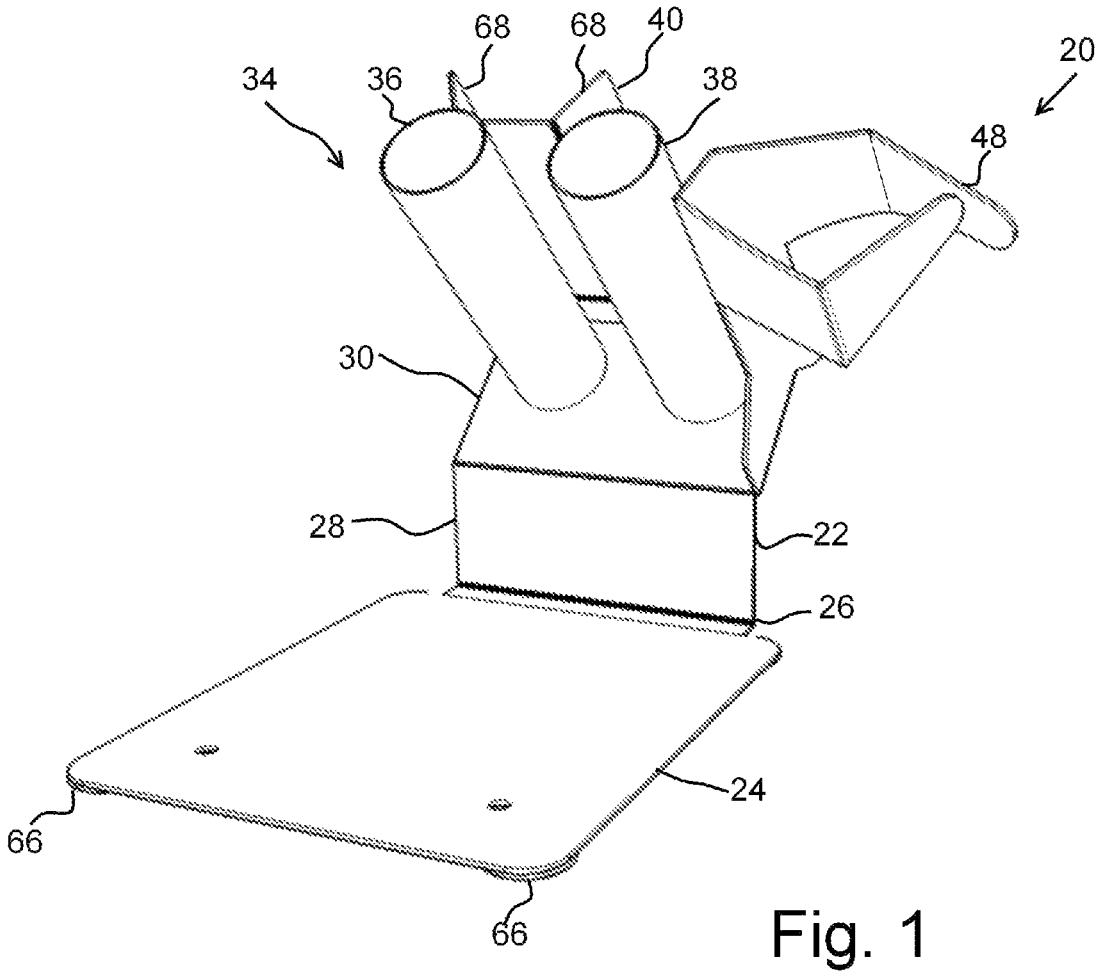
FIG. 1 is a front isometric view of a three appliance holder in a tabletop arrangement.
Figure 2:
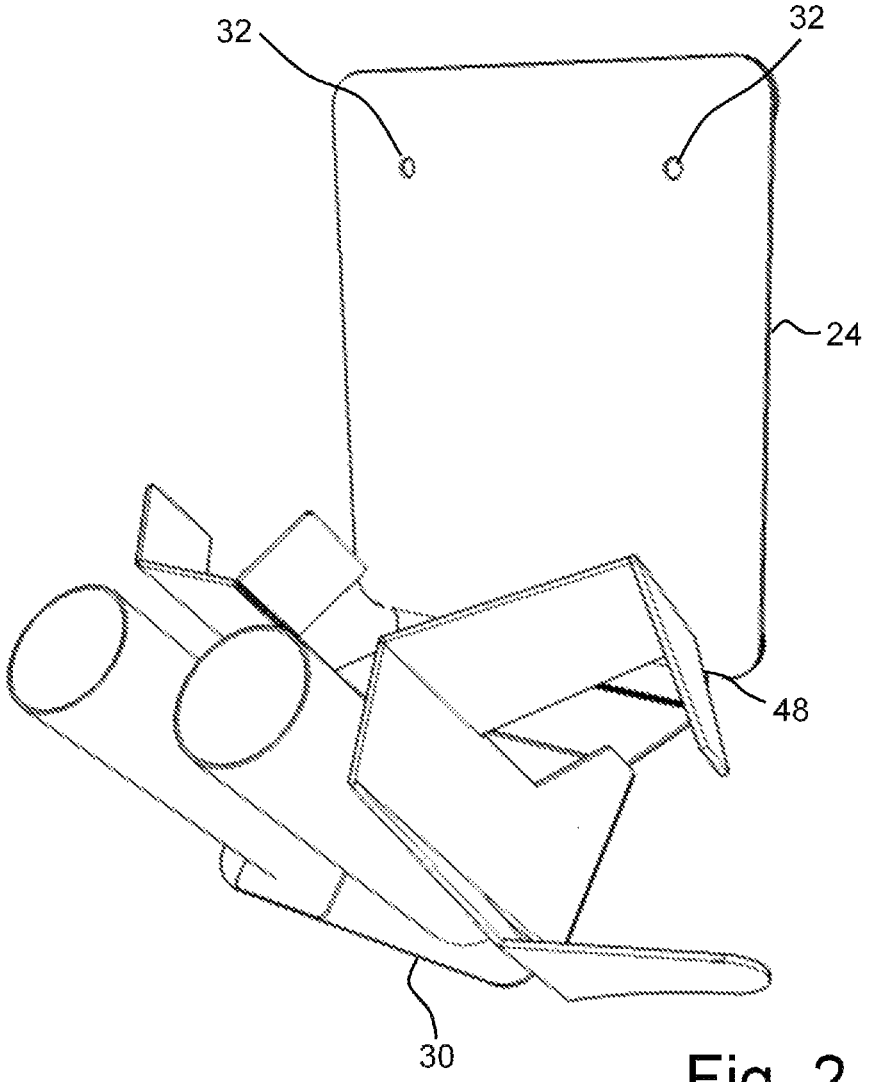
FIG. 2 is a front isometric view of the embodiment of FIG. 1 in a wall-mounted arrangement.
Figure 3:
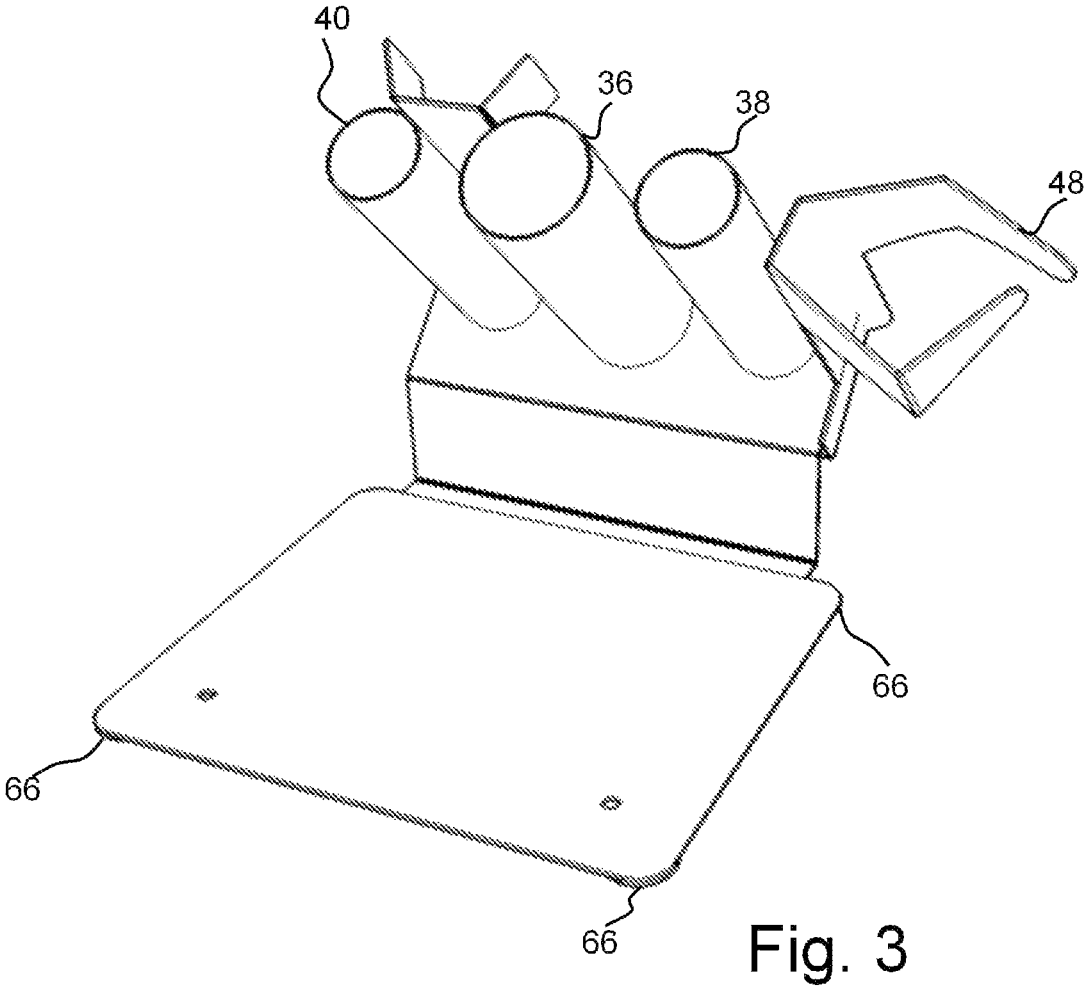
FIG. 3 is a front isometric view of a four appliance holder in a tabletop arrangement.

Looking to FIG. 1, it can be seen how this embodiment of the modular appliance holding system 20 generally comprises a support 22. The support in turn comprising a base 24, bend 26, upright portion 28 and attachment panel 30. FIG. 1 further shows one embodiment of the holding system as sitting upon or attached to a horizontal work surface such as a table, workbench, cabinet, or shelf. The embodiment shown in FIG. 2 is substantially identical in these components; however, the base 24 is shown mounted to a vertical surface, such as a wall. In one form this embodiment is secured to the vertical surface by a plurality of fasteners 72 passed through a plurality of voids 32 and then screwed, bolted, riveted, or otherwise fastened to the vertical surface. As such, several of the components including the clip 40 and hook 48 may be attached in a different manner than that shown in FIG. 1 if desired by the user.

Figure 9:
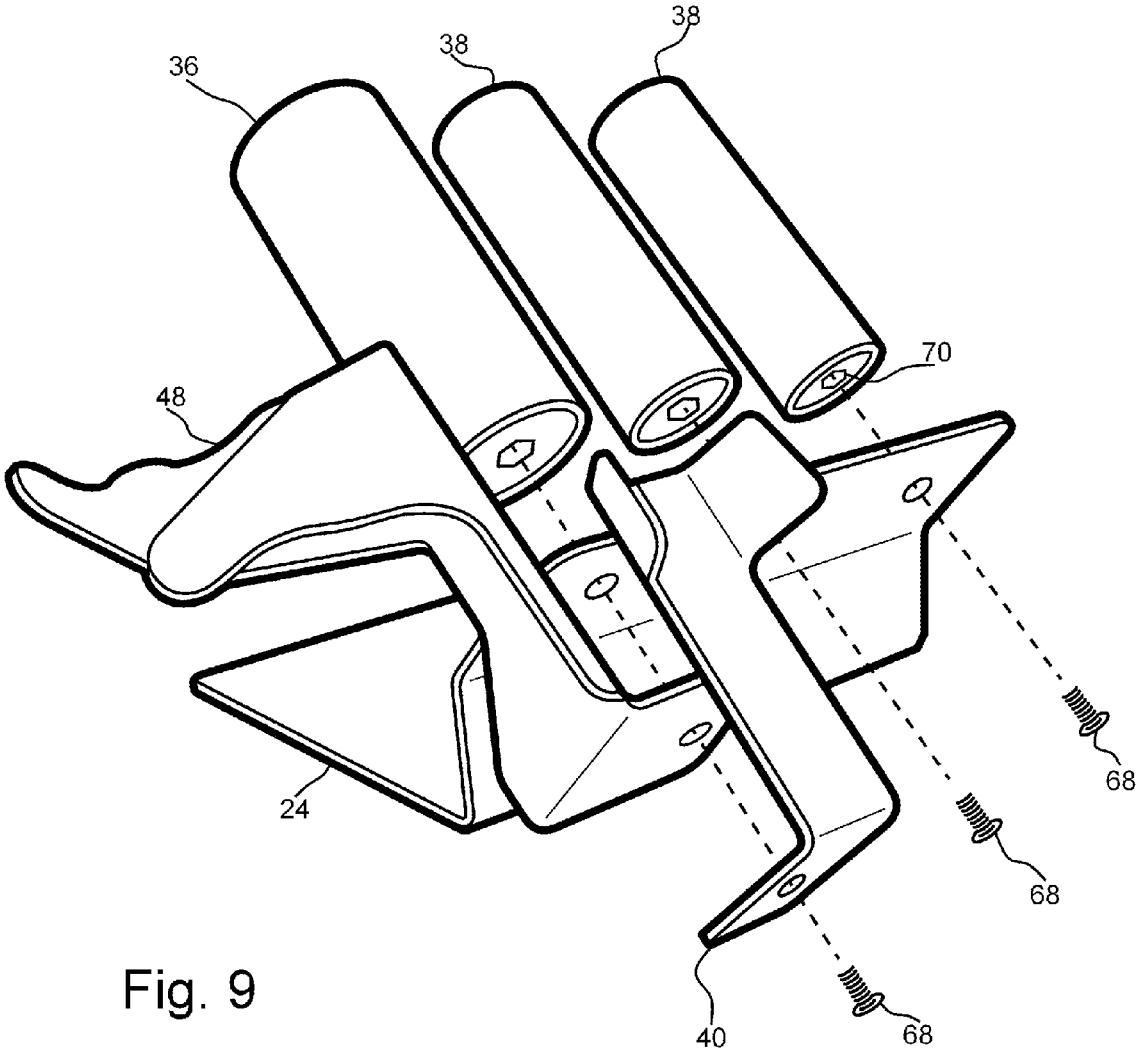
FIG. 9 is a rear isometric assembly view of an embodiment for a table top arrangement.
Figure 10:
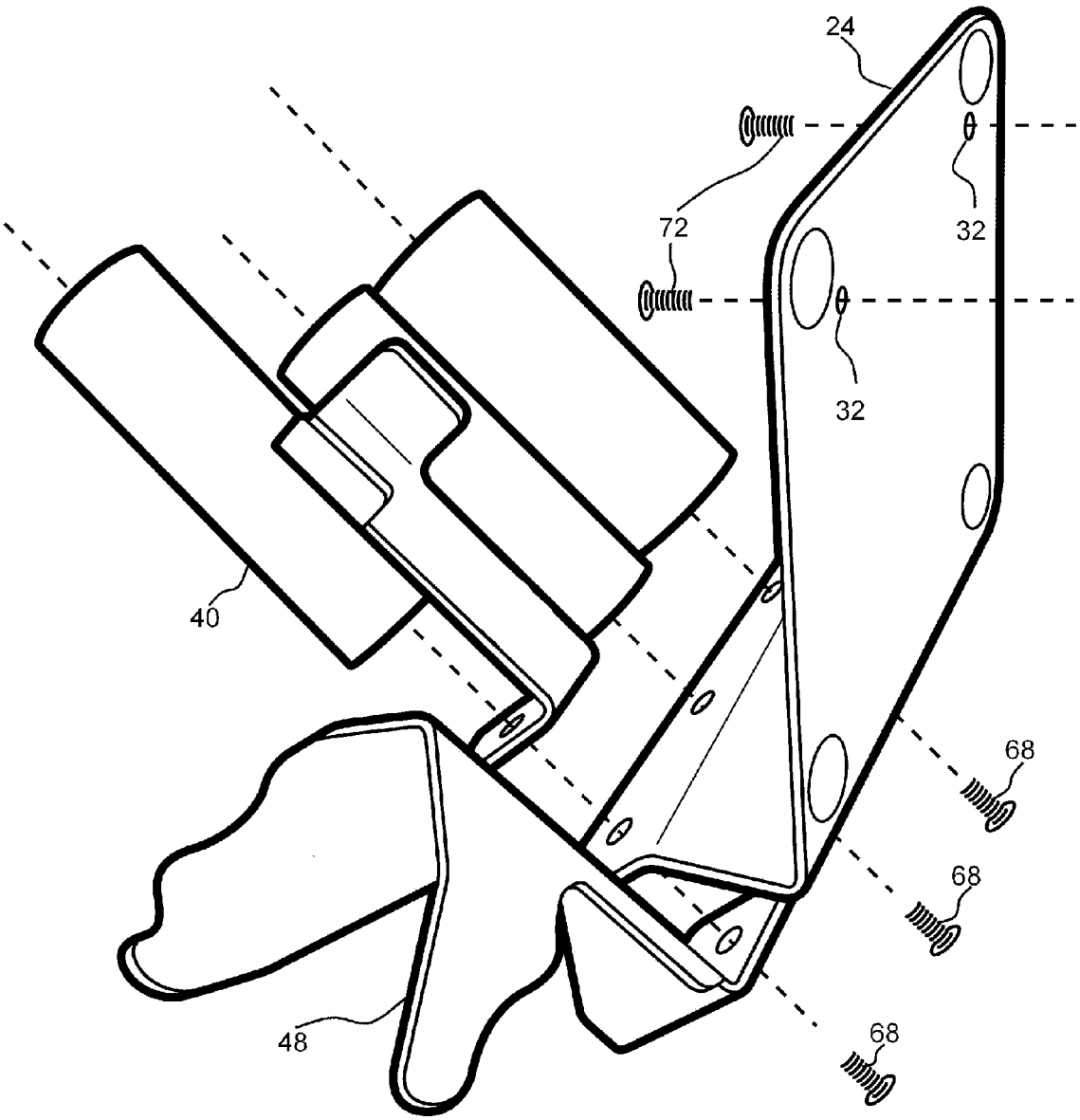
FIG. 10 is a rear isometric assembly view of an embodiment for mounting on a vertical surface.

Continuing with a description of the components shown in FIG. 1, the attachment panel 30 comprises a plurality of voids therein such as may be more easily seen in FIGS. 9 and 10. Through these voids may be passed a fastener 68 to attach to a system of receiving tubes 34 (for example smaller tubes 38 and larger tubes 36) and/or other components. In one embodiment, the components each comprise an interior bottom wall comprising a surface defining a threaded void 70 for receiving and fastening of the fasteners 68. By way of example, a larger tube 36, may be utilized for curling or flat irons, hot combs, and similar appliances having a substantially large diameter, while a smaller tube 38 may be used for similar appliances having a relatively small diameter. In this disclosure, the term flat iron will be used to represent such appliances.

While tubes of different cross sections such as square, rectangle, triangle, or other geometries may be used, cylindrical tubes have been found to be easily constructed and utilized.

As it is known that it is often not desirous to have a flat iron closed such that the clamp portion is against the element or heating portion. In this disclosure, a clip 40 may be provided as shown in FIG. 1 which may attach to the attachment panel 30 or alternatively directly to a portion of the tube 34. This clip creates a heat insulating barrier between the clamp 42 and the heating element 44 of a flat iron 46.

In one form, the clips 40 include a pair of upwardly and outwardly extending wings 68 to maintain the clamp portion of the flat iron in the desired position.

Due to the design of the attachment system of the tubes 34, clip 40, hook 48 and other components, the components may be interchanged, or re-arranged as needed. For example, the embodiment shown in FIG. 1 comprises a single small tube 38 and a single large tube 36. Although the embodiment shown in FIG. 5 utilizes a single larger tube 36*a* and a plurality of smaller tubes 38*a-c*. It can also be seen how in this embodiment both the larger tube 36*a* and the smaller tube 38*b* have been fitted with clips 40*a* and 40*b*.

Figure 5:
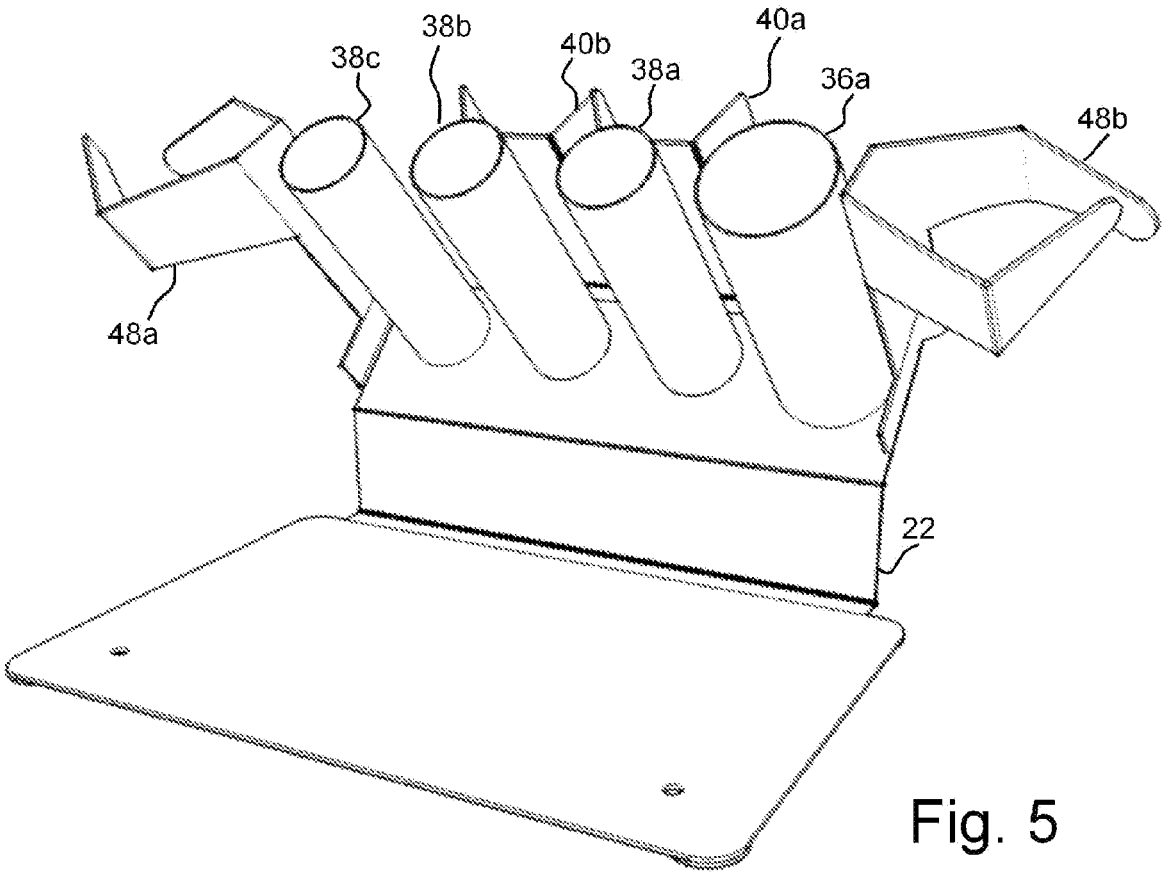
FIG. 5 is a front isometric view of a six appliance holder in a tabletop arrangement.
Figure 6:
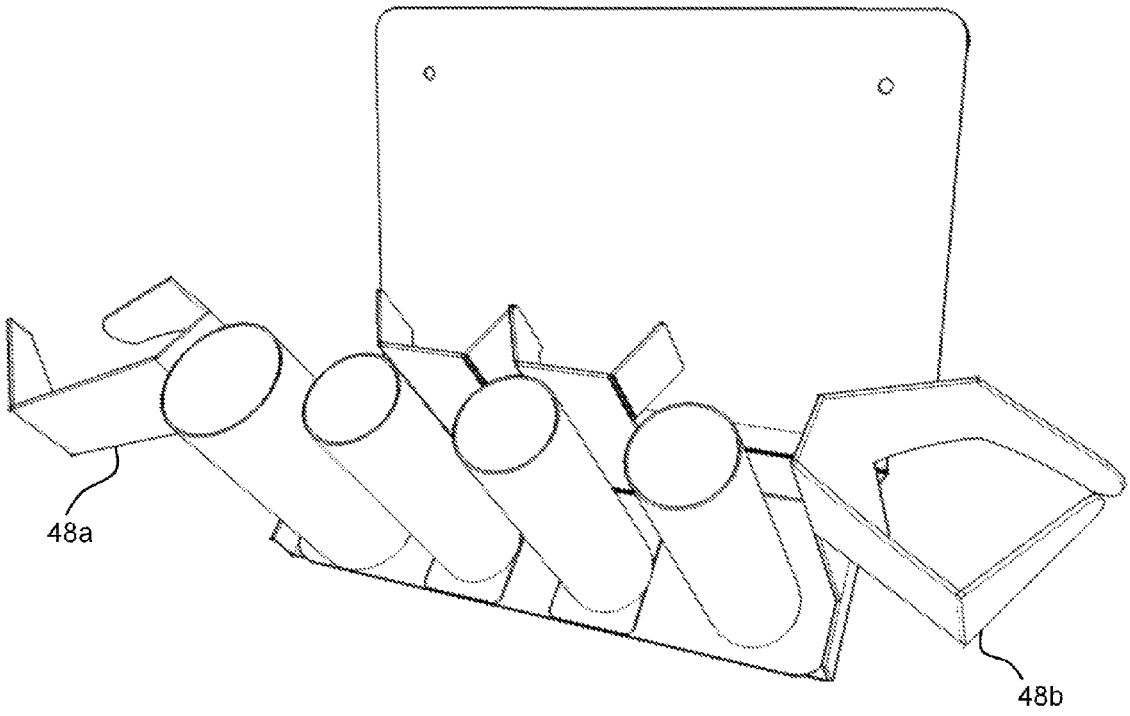
FIG. 6 is a front isometric view of the embodiment of FIG. 5 in a wall-mounted arrangement.

In addition, FIG. 5 for example shows two slightly different hooks 48*a* and 48*b* for use on right and left sides of the apparatus. When the apparatus is converted to use on a vertical surface as shown in FIG. 6, the hooks may be reversed as shown.

Figure 4:
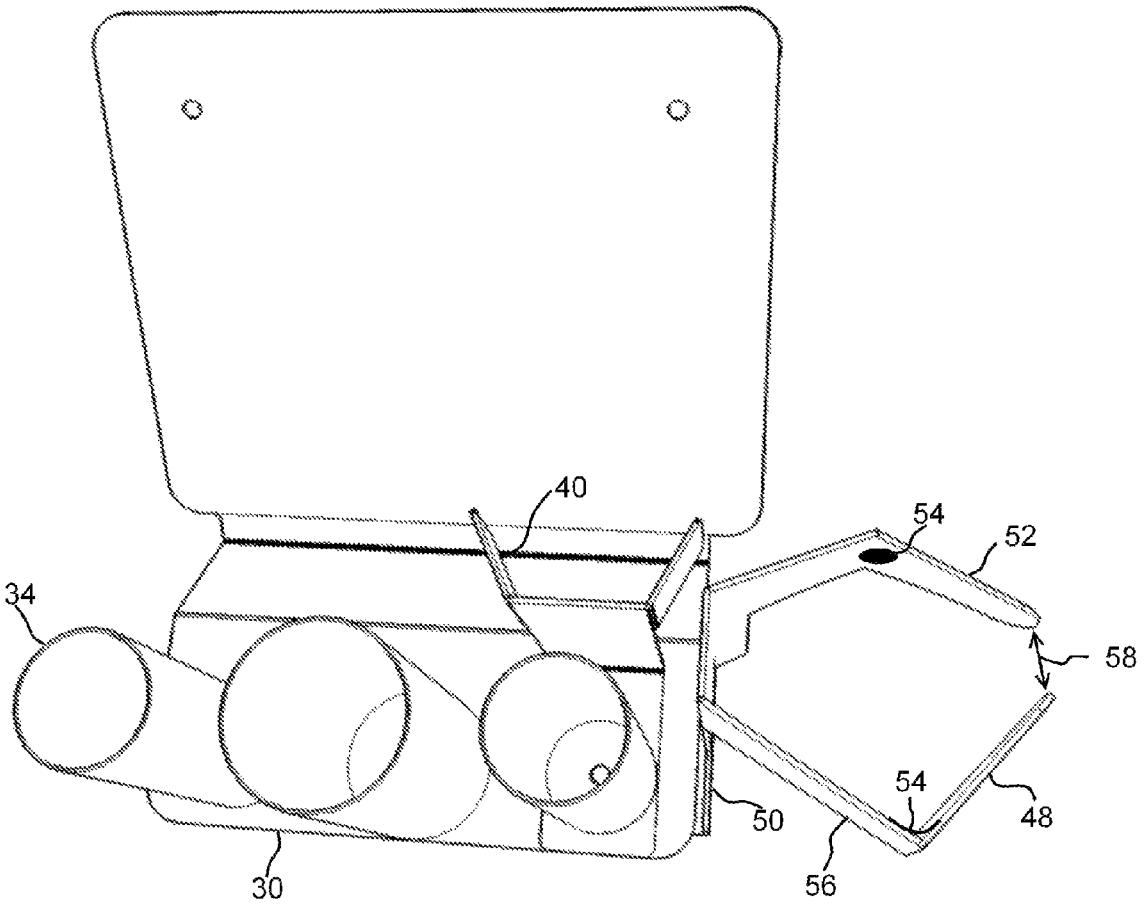
FIG. 4 is a front isometric view of the embodiment of FIG. 3 in a wall-mounted arrangement.
Figure 7:
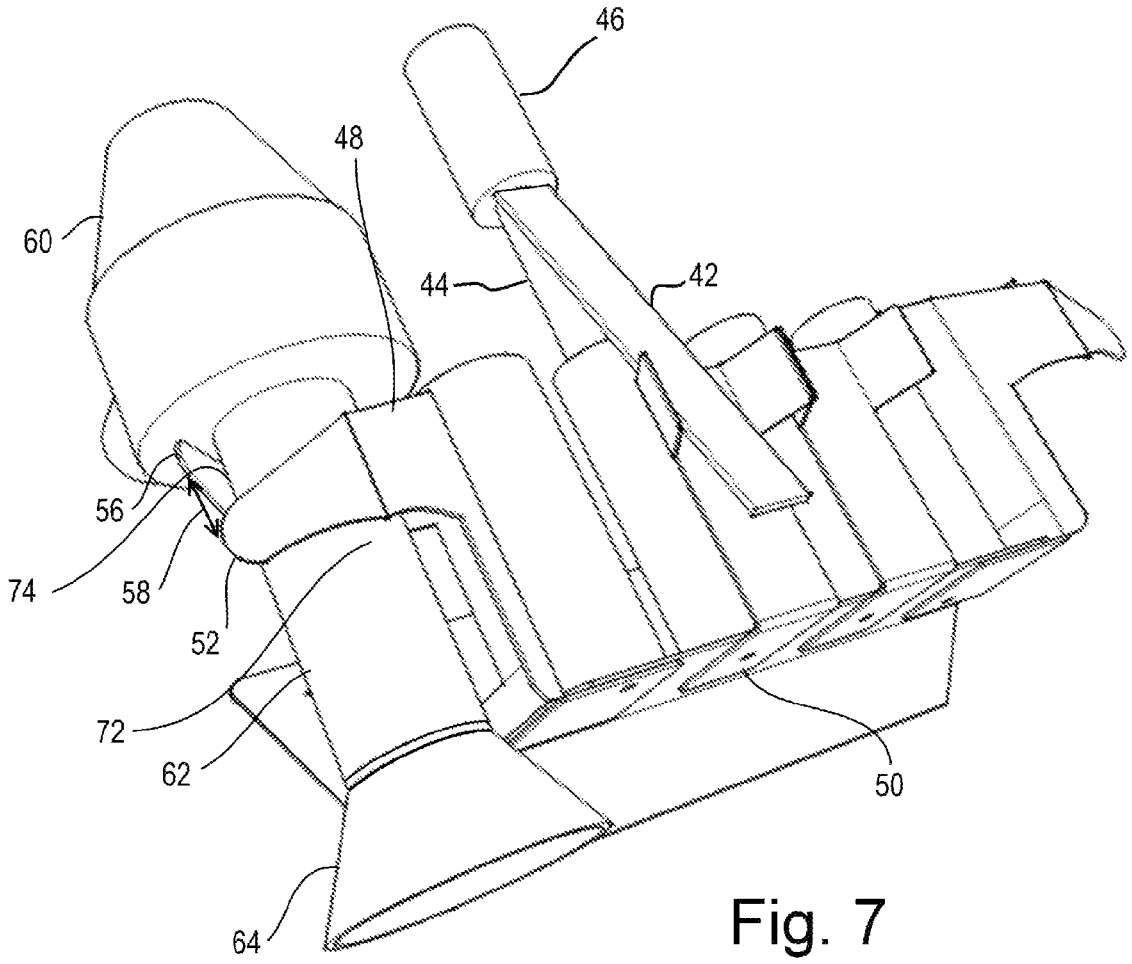
FIG. 7 is a side isometric view of the embodiment of FIG. 5 in a table-top arrangement holding two appliances.
Figure 8:
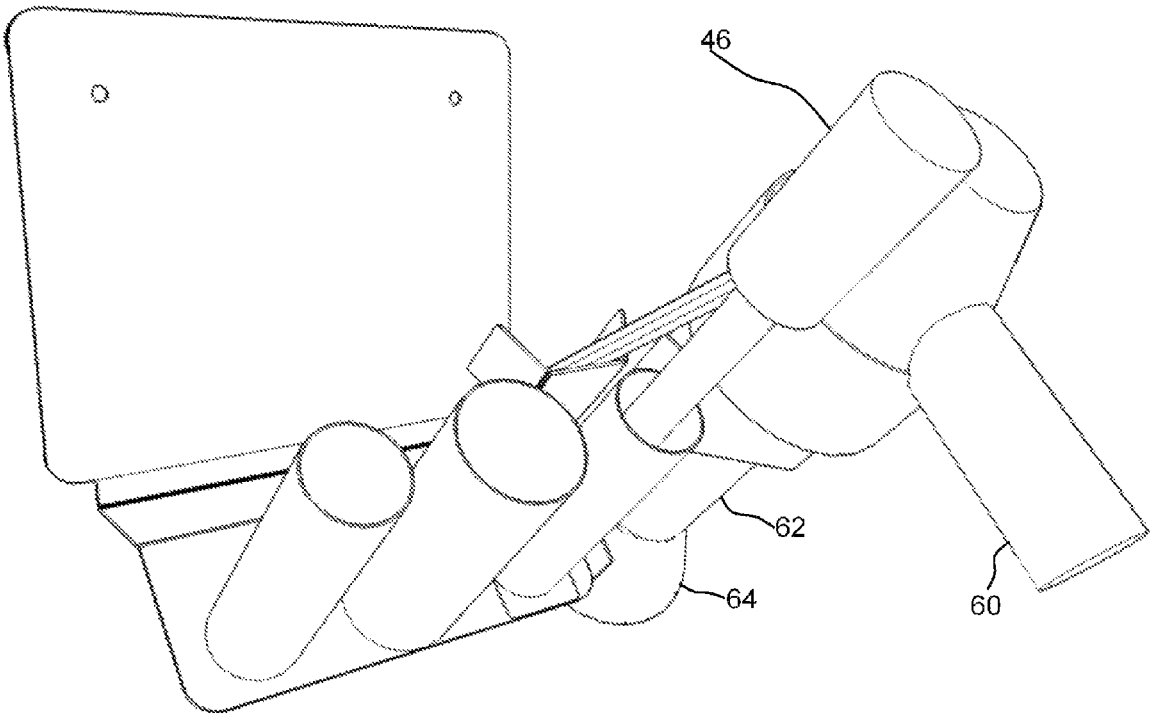
FIG. 8 is a front isometric view of the embodiment of FIG. 5 in a wall-mounted arrangement holding two appliances.

Looking to FIGS. 4 and 7, it can be seen how this arrangement of the modular appliance holding system 20 utilizes a three-tube embodiment with a singular hook 48 for holding of a hair dryer 60 or similar apparatus. As can be seen, this embodiment of the lower portion 50 of the clip 48 attaches to the attachment panel 30 and extends outward to a bend and then extends forward generally in alignment with the tubes 34. A first engagement arm 52 extends therefrom and may incorporate a pad 54, such as a nonskid, foam-like portion. A second arm 56 is also utilized in the same manner as the first arm 52. As can be seen, a gap 58 between the outer edges of the first arm 52 and second arm 56 is large enough to accept the outlet or exhaust portion 62 of a hair dryer 60 (see FIG. 8). In some applications, the hair dryer 60 may utilize a diffuser 64 or similar component, which commonly prohibits engagement of the hair dryer into prior holders. Thus, the operator must remove the diffuser before placing the hair dryer into such receivers (holders), or alternatively, the user may rest the hair dryer upon a work surface such as a counter top or shelf. This requirement of removing a diffuser prior to stowing the hair dryer is detrimental to use and often results in the hair dryer sliding off the work surface and impacting the floor. Such an impact with the floor or other hard surface is normally detrimental to the hairdryer.

As can be understood looking to one embodiment of the right hand hook 48 shown in FIG. 2, to place the hair dryer in the hook 48, the user may lift (rotate) the handle of the hair dryer to clear the arms 52 and 56, reposition the hair dryer leftwards (laterally) into the receiving portion of the hook 48. Normally the user would then lower (rotate) the handle 74 such that the exhaust port 62 would engage the inner portions of both arms 52 and 56, thus holding the hair dryer in place without any significant repositioning of the arms (52/56) of the hook 48 relative to each other. If no large diffuser 64 or similar component is used, the exhaust portion 62 may be longitudinally inserted into the hook 48 in a traditional manner. In either case, no lateral force must be engaged against the system 20 to laterally position a hair dryer in place. These actions of placing a hair dryer in a right hand hook would be reversed to place a hair dryer in a left hand hook.

In another embodiment, the arms 52 and 56 may be slightly flexible, and deform away from each other slightly if the diameter of the hair dryer is larger than the net gap 58.

Looking to the embodiment of FIGS. 5 and 6, it is understood that the apparatus may utilize a plurality of substantially mirror image hooks 48*a* and 48*b* on alternate sides of the support 22 as previously mentioned. It can also be seen by comparing FIGS. 5 and 6, how a hook 48*a* will be repositioned from one side to the other when the apparatus is converted from a free-standing or horizontal application as shown in FIG. 5, to a wall mounted operation as shown in FIG. 6.

One significant advantage of the embodiments shown in FIGS. 1, 3, 5 and 7 is that the base 24 can be used as workspace to receive hairbrushes, combs and other elements while the overall apparatus does not significantly reduce the workspace available to an operator as the base 24 can be used as a substantially planar portion of the workspace. The embodiments shown in FIGS. 2, 4, 6, and 8, also clearly do not reduce the workspace available to an operator as these embodiments are attached to a wall or other substantially vertical surface such as a cabinet etc.

As the tubes 34 and hooks 48 are positioned above the base 24 in a table top arrangement, the base 24 provides a very stable platform, especially when the overall apparatus is made of a relatively heavy material, such as heavy gauge aluminum, steel, or high-density polymers. The base 24 may also be thermally isolated, and held from sliding across the surface of the workspace by feet 66 which can be seen in FIGS. 1, 3, and 5.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore I claim:

1. A modular hair appliance holder comprising:

a) a base comprising a support surface; an upright portion extending from the support surface, the upright portion defining an attachment panel;

b) a plurality of hair appliance holding tubes removably attached to the attachment panel; and c) the base comprising a wall attachment system whereupon the base is configured to be selectively attached to a vertical surface, and rest upon a horizontal surface;

d) the upright portion extending from a rearward portion of the support surface as the modular hair appliance holder rests upon a horizontal surface;

e) the upright portion extending from a lowermost portion of the support surface as the modular hair appliance holder is attached to a vertical surface; and f) wherein the hair appliance holding tubes are operable in either configuration.

2. The hair appliance holder as recited in claim 1 further comprising:

a) a clip removably attached to the support surface and offset from an adjacent hair appliance holding tube; and b) the clip configured to provide a thermal barrier between the adjacent hair appliance tube and the clip.

3. The hair appliance holder as recited in claim 2 wherein the clip further comprises a plurality of wings.

4. The hair appliance holder as recited in claim 1 further comprising:

a) a hair dryer holding hook removably attached to the support surface; and b) the hair dryer holding hook further comprising a first arm and a second arm with a longitudinal gap provided between distal ends of the first and second arms to allow lateral passage of an exhaust port of the hair dryer.

5. The hair appliance holder as recited in claim 4 further comprising at least one malleable pad on the first arm.

6. The hair appliance holder as recited in claim 5 further comprising at least one malleable pad on the second arm.

7. The hair appliance holder as recited in claim 4 further comprising at least one malleable pad on the second arm.

8. The hair appliance holder as recited in claim 1 wherein the support surface is attached to the base at an obtuse angle and extends vertically above and horizontally rearward of the base when the hair appliance holder is resting on a horizontal surface.

9. The hair appliance holder as recited in claim 1 wherein each hair appliance holding tube comprises:

a) an upper end open to accept a hair appliance;

b) a lower end having an interior bottom wall;

c) a surface defining a void through the interior bottom wall;

d) a surface defining a void through the attachment panel;

e) a fastener passing through the surface defining a void through the interior bottom wall and through the surface defining a void through the attachment panel thus attaching the hair appliance holding tube.

10. A modular hair appliance holder comprising:

a) a base comprising a support surface;

b) an upright portion extending from the support surface, the upright portion defining an attachment panel;

c) a plurality of hair appliance holding tubes removably attached to the attachment panel;

d) the base comprising a wall attachment system whereupon the base is configured to be selectively attached to a vertical surface, and rest upon a horizontal surface;

e) wherein the hair appliance holding tubes are operable in either configuration;

f) a hair dryer holding hook removably attached to the support surface; and g) the hair dryer holding hook further comprising a first arm and a second arm with a longitudinal gap provided between distal ends of the first and second arms to allow lateral passage of an exhaust port of the hair dryer; and h) wherein the distal end of the first arm of the hair dryer hook is horizontally forward of the distal end of the second arm such that a net distance between the distal end of the second arm and the distal end of the first arm is greater than a vertical gap between the distal end of the second arm and the distal end of the first arm.

* * * * *